US005393010A

United States Patent [19]

Renck

[11] Patent Number: 5,393,010

[45] Date of Patent: Feb. 28, 1995

[54] TUBULAR CORE ASSEMBLY FOR WINDING PAPER AND OTHER SHEET MATERIAL HAVING MECHANCIALLY INTERLOCKED END MEMBERS

[75] Inventor: Lawrence E. Renck, Hartsville, S.C.

[73] Assignee: Sonoco Products Company, Hartsville, S.C.

[21] Appl. No.: 49,550

[22] Filed: Apr. 20, 1993

[51] Int. Cl.[6] ..... B65H 75/50

[52] U.S. Cl. ..... 242/613.5

[58] Field of Search ..... 242/68.3, 68.4, 68.5, 242/68.6, 68.7, 613.4, 613.5

[56] References Cited

U.S. PATENT DOCUMENTS

| | | | |
|---|---|---|---|
| 1,118,860 | 11/1914 | Howarth | 242/68.6 |
| 1,137,470 | 4/1915 | Elixman | 242/68.6 |
| 2,052,541 | 8/1936 | Roberts et al. | 242/68.6 |
| 2,076,870 | 4/1937 | Taylor | 242/68.6 |
| 3,204,763 | 9/1965 | Gustafson | 242/68.5 |
| 3,275,257 | 9/1966 | Cherniavskyj | 242/68.3 |
| 3,482,607 | 12/1969 | Villani et al. | 242/68.4 |
| 4,295,921 | 10/1981 | Bopst, III | 242/68.4 X |
| 4,874,139 | 10/1989 | Kewin | 242/68.6 |
| 4,875,636 | 10/1989 | Kewin | 242/68.6 |
| 5,236,141 | 8/1993 | Kewin | 242/68.6 |

FOREIGN PATENT DOCUMENTS

| | | | |
|---|---|---|---|
| 785147 | 5/1968 | Canada | 242/68.6 |
| 1238302 | 4/1967 | Germany | 242/68.6 |
| 888860 | 2/1962 | United Kingdom | 242/68.6 |

*Primary Examiner*—Daniel P. Stodola
*Assistant Examiner*—John P. Darling
*Attorney, Agent, or Firm*—Bell, Seltzer, Park & Gibson

[57] ABSTRACT

A tubular core assembly for winding or unwinding of sheet material, such as newsprint or Rotogravure Print, is provided wherein the opposed ends of an elongate cylindrical core are provided with inside diameter-reducing annular end members. The inside diameter-reducing annular end members are mechanically interlocked with a central core body which is preferably formed by multiple wraps of a paperboard material. Mechanical interlocking is accomplished by a plurality of axial grooves in the bodywall of the central core body member and a plurality of axially extending tongue members on the annular end members which are received in the grooves of the central core body member in interlocking relationship therewith. Because of the mechanical interlocking relationship between the inside diameter-reducing annular end members and the central core body member, the inside diameter-reducing annular end members are secured to the central core body member in positive circumferential and axial locking relationship.

18 Claims, 2 Drawing Sheets

TUBULAR CORE ASSEMBLY FOR WINDING PAPER AND OTHER SHEET MATERIAL HAVING MECHANCIALLY INTERLOCKED END MEMBERS

FIELD OF THE INVENTION

The invention relates to a tubular core of the type used for winding paper, such as newsprint, film and other sheet material. More specifically, the invention is directed to a tubular core assembly having mechanically interlocked end members for reducing the inside diameter of the ends of the tubular core.

BACKGROUND OF THE INVENTION

Tubes and cores are widely used in the film and paper industry for winding film and paper into roll form. These cores are usually made of paperboard and are formed by a spiral or convolute wrap process. Thus, one or more plies of paperboard are coated with adhesive and wrapped around a mandrel to seal each layer to the next in the structure. For lightweight uses, the tubes or cores are made of lightweight paperboard and may have only a few layers. However, for heavy duty uses, such as for winding and unwinding for newspaper and Rotogravure printing, the tubes are usually very long, for example up to about 10 ft. (3.08 m.) for U.S. Rotogravure printing and 10.5 ft. (3.22 m.), for European Rotogravure printing. In view of the large size, these tubes must be of very heavy or thick construction to be able to carry the weight of a large roll of paper.

In use on winding and unwinding equipment, the tubular cores are mounted on stub shafts or chucks of standard size. U-shaped metal end caps are typically inserted into the open ends of the tube to assist in more positive mounting of the paperboard cores on the chucks or stub shafts of the winding and unwinding equipment.

Many paperboard cores used in film and paper processes have a three-inch inside diameter and much of the commercially used equipment have chucks and stub shafts designed to cooperate with three-inch inside diameter cores. Because of this equipment design, equipment users are limited to use of the three inch inside diameter cores.

At times, printers and/or film manufacturers prefer to use a larger tubular core on equipment designed for use with a core of smaller diameter in order to improve both vibration and dynamic strength performance. For example, many conventional cores have a six-inch inside diameter and it is clear that the use of six-inch inside diameter core with equipment designed to support a core having a three-inch inside diameter can significantly impact vibration during the winding and unwinding process.

U.S. Pat. No. 4,875,636 to Kewin discloses a nonreturnable newsprint carrier system in which the newsprint cylindrical core can be used without the need for metal end caps. The inside surfaces of the opposite end portions of the tubular core have substantially the same non-cylindrical configuration, profile and dimensions as the outside surfaces of the reel stub shafts of an offset printing press so that the tubular core and newsprint stub shaft will have a full profile fit in surface-to-surface contact over substantially the entire surface of the reel stub shafts inserted within the core during use thereof.

U.S. Pat. No. 4,874,139 to Kewin discloses tubular core assemblies which include an annular core insert member which may be made of a cellulosic material, permanently bonded to the inside end of a tubular paperboard core. The use of such an interior annular core insert can allow for the use of a smaller wall thickness paperboard tube. In practice, there is a problem with the annular core insert because it is fastened to the interior of the inside tube by an adhesive. The exterior of the core insert must have a tight fit with the interior of the core, inside the tube, to eliminate vibration and wobble in high speed winding and to try to keep the insert from breaking loose during sudden acceleration or deceleration of the unwind machine. Because of the relatively close tolerance fit between the annular core insert and the inside of the core, the adhesive, intended to bond the annular core insert to the core, is typically wiped out of the minimal space between the insert and the core during the axial insertion process. Moreover, unless the exterior surface of the annular core insert and the interior surface of the tube, are perfectly symmetrical and circular, gaps can be left between the two surfaces where no bonding occurs. Thus, in practice, the annular core inserts are seldom adhered securely to the tube and very seldom survive the winding operation, much less the unwinding operation.

The elimination of metal end caps for the mounting of cores on winding and unwinding equipment would be highly desirable. However, in practice the proposed systems of the prior art include various disadvantages as discussed above, including the poor bonding between interior annular core inserts and the ends of the tubular core and/or the need to reduce the diameter of inside portions of the tubular core in order to provide a tube with an inside surface having a profile matching the exterior profile of the reel stub shafts of winding and unwinding equipment. Moreover, there is no practical solution provided in the art for the recurring needs and desires of manufacturers to employ large diameter cores on equipment designed for use with smaller diameter cores.

SUMMARY OF THE INVENTION

According to the invention, a tubular core assembly includes a central paperboard core body having mechanically interlocked annular end members secured to each of its opposed ends for reducing the inside diameter of the ends. The inside diameter-reducing annular end members are secured to the central core body member in positive circumferential and axial locking relation. Because the inside diameter-reducing annular end members are positively engaged with both axial and circumferential surfaces of the central core body member, the invention provides a practical and readily available means for reducing the inside diameter of the ends of large cylindrical cores while preserving and/or enhancing the integrity of the large cylindrical core so that the large cylindrical cores can readily be used with winding and unwinding equipment designed for use for smaller cores. In addition, the inside surfaces of the annular end members can be configured and profiled to match the outside dimensions of conventional stub shafts or chucks of conventional winding and unwinding equipment.

The tubular core assembly of the invention includes an elongate hollow center cylindrical core body having a bodywall preferably formed by multiple wraps of a paperboard material and having opposed ends, a predetermined outside diameter, and a predetermined inside diameter. Annular end members, each having an exterior periphery, of which at least a portion defines the same outside diameter as the central core body, and which have a smaller inside diameter as compared to the central core body, are attached to each of the opposed ends of the central core body member in co-axial relationship therewith by integral mechanical interlocking means. The integral mechanical interlocking means comprise a plurality of axial grooves or notches in the central core body, each having a depth extending substantially through the bodywall thereof. A plurality of axially extending tongue members on each of the annular end members are received in the grooves of the central core body in interlocking relation therewith. The integral mechanical interlocking means provides for positive circumferential and axial engagement between the inside diameter-reducing annular end members and the central core body so that rotational motion applied to the annular end members is positively transferred to the central core body and so that axially inward force applied to the annular end members is directly transferred to the central core body with the result that the end members have improved rotational and axial load capabilities.

The inside diameter-reducing annular end members are readily formed from various cellulosic-based and/or polymer-based composite materials including wood particles or chips, wood pulp, paperboard, and/or liquid or solid polymers, preferably by conventional molding operations. The tubular core assemblies of the invention can be used without the need for metal end caps or inserts.

The inside diameter-reducing annular end members can have various exterior shapes and profiles according to various preferred embodiments of the invention. Because the annular end members reduce the inside diameter of the tube and increase the wall thickness at the ends of the completed assembly, these end members also provide increased strength to the ends of the tubular core assembly. The inside annular surfaces of the inside diameter-reducing end members can be provided with shapes and profiles matching the exterior profiles of conventional chucks and/or reel stub shafts of winding and unwinding equipment so that such chucks and/or reel stub shafts can be inserted into the core assemblies of the invention in surface-to-surface contact with the inside surface of the core assembly as disclosed in U.S. Pat. No. 4,875,636 to Kewin, which is hereby incorporated by reference. The tubular core assemblies of the invention can be used with conventional core plugs during shipping of empty cores and/or fully wound rolls of paper and the like.

BRIEF DESCRIPTION OF THE DRAWINGS

In the drawings which form a portion of the original disclosure of the invention.

DESCRIPTION OF THE PREFERRED EMBODIMENT

In the following detailed description, exemplary preferred embodiments of the invention are described to enable practice of the invention. It will be apparent that the terms used in describing the invention are used for the purpose of description and not for the purpose of limiting the invention to the preferred embodiments. It will also be apparent that the invention is susceptible to numerous variations and modifications as will become apparent from a consideration of the invention as shown in the attached drawings and described herein.

Figure 1:
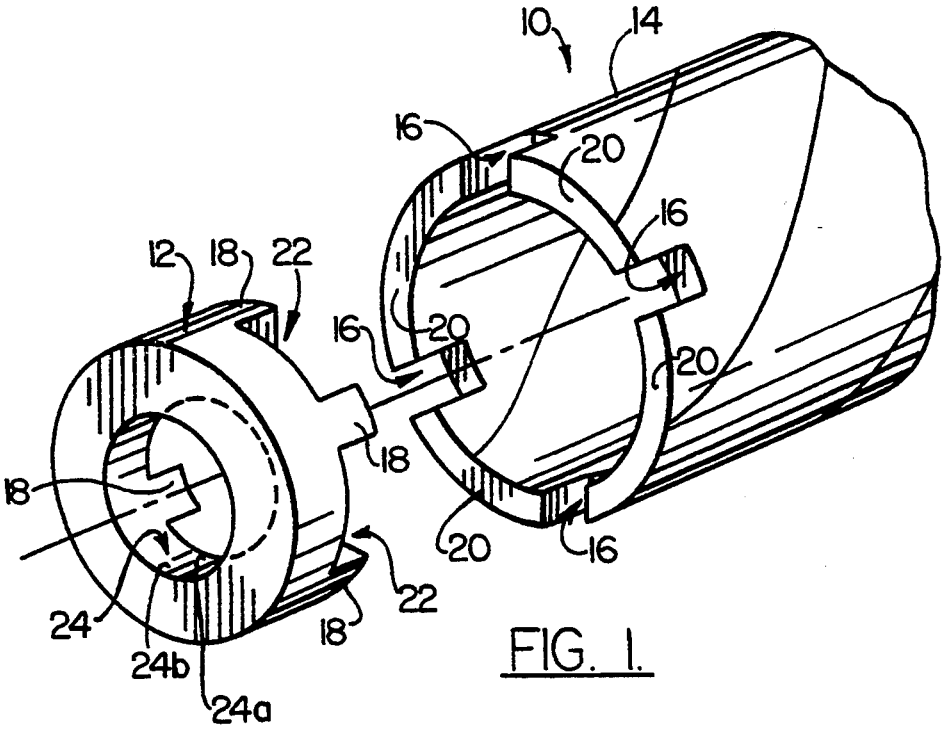
FIG. 1 is an exploded perspective view of one end portion of one preferred tubular core assembly of the invention, the other end being identical.

FIG. 1 illustrates an exploded perspective view of one end of a tubular core assembly of the invention. The opposed end of the tubular core assembly (not shown) is identical to the end shown in FIG. 1 as will be apparent. The tubular core assembly includes a central core body member 10 and an inside diameter-reducing annular end member 12. The central core body member 10 is defined by a cylindrical hollow bodywall 14 formed by multiple wraps of a paperboard material.

As illustrated in FIG. 1, the bodywall 14 is formed by a spiral wrapping process; however, the bodywall can also be formed of a single layer of plastic or similar material by a molding or extrusion process; or multiple layer wrapped tubular bodies can alternatively be formed by a conventional convolute wrapping process. In the preferred embodiments, the bodywall 14 will include multiple paperboard layers. Both the spiral wrapping process and the convolute wrapping process are well known to those skilled in the art. In general, such processes involve the wrapping of one or more adhesive coated plies around a mandrel to provide a tubular body. The thickness of the bodywall and the density of the paperboard ply used in the wrapping process are chosen to provide the desired strength in the resultant bodywall. For example, where the core is intended for light-duty or light-weight uses, the paperboard ply can have a light density and/or light weight and the bodywall thickness can be relatively low, for example, in the range of from about 0.125 inches to about 0.25 inches. On the other hand, for heavy-duty uses, a thicker bodywall, for example in the range of between about 0.5 inches and about 0.875 inches is needed and typically a heavy and/or thick paperboard ply material is used.

A plurality of grooves or notches 16 are provided in the annular ends of the bodywall for receiving matching, axially extending tongues or tenons 18 of the end members 12. Preferably, the grooves 16 extend entirely through the bodywall 14 of the central core body member 10 as shown in FIG. 1 although the notches or grooves 16 can be formed less than completely through the bodywall 14. In such instances, the grooves or notches 16 preferably extend substantially through the bodywall 14, i.e. the grooves 16 preferably extend more than 50 percent through the thickness of the bodywall 14. In this regard, it is important that rotational motion imparted to the end members 12 or to the central core body member 10 be fully transferred to the other member or members. Thus, extension of the grooves 16 preferably substantially through the bodywall 14 insures positive circumferential locking of the end member 12 into the central core body 10.

Returning to FIG. 1, the central core body member 10 also includes a plurality of tongue members 20 which are formed alternatively between the axial grooves 16 in the central core body member. The tongues 20 are profiled and configured to match grooves 22 formed in the inside diameter-reducing annular end member 12.

It will be apparent that the sizes and arrangements of the grooves and tongues shown in FIG. 1 can be widely varied. Thus, in FIG. 1, the grooves 16 are shown as having a smaller circumferential dimension, i.e. width, than the tongues 20 in the main body member 10. However, in another advantageous embodiment of the invention, the grooves 16 can have a grater circumferential dimension than the circumferential dimension of the tongues 20 in the central core body member. In such event, it will be apparent that the tongues 18 and grooves 22 on the inside diameter-reducing end members 12 will be modified to correspond to the dimensions of the tongues 20 and grooves 16 on the central core body member 10. Likewise, the tongues 20 and grooves 16 on the central core body member 10 can be configured to have identical circumferential dimensions with respect to one another.

Additionally, although the tongues 20 and grooves 16 in the central core body member 10 are each illustrated as having a substantially rectangular shape, it will also be apparent that the tongues 20 and grooves 16 can be beveled in either or both the axial direction or radial direction, or the tongues and grooves can be triangularly shaped to form a series of interlocking teeth, where desirable. However, the rectangular shaped tongues and grooves illustrated in FIG. 1 are preferred for ease of manufacture. In this regard, as indicated previously, the central core body member 10 is manufactured by a paperboard winding process. Typically, the paperboard tube is manufactured as a continuous member and is severed into tubes of the desired length during the manufacturing process. The ends of the individual tubes are thereafter treated, as by grinding or cutting, to form the grooves 16 in the ends of the paperboard tube.

Preferably, there are at least three and more preferably, four grooves 16, formed in the end of the central core body 10 as illustrated in FIG. 1. The use of at least three grooves ensures that the inside diameter-reducing end members 12 will be radially centered i.e., coaxially positioned, with respect to the central axis of the central core body member 10. More preferably, there are four, six or another even number of symmetrically oriented grooves 16, preferably four grooves, formed in the central core body member 10 in order to improve manufacturing efficiency. In this regard, pairs of opposed grooves arranged 180° with respect to each other can be cut using a single blade and a single cutting operation. Thus, it will be apparent that the four grooves 16 illustrated in FIG. 1 can be cut into the central core body member using only two cutting operations; one cutting operation employing a first blade for cutting the opposed top and bottom grooves 16, using a single pass of the blade across the annular end of the tube from top to bottom, and a second cutting operation using a second blade for cutting the two opposed side grooves 16 in a single pass.

The inside diameter-reducing end members 12 are formed, as indicated previously, by any of various well known processes, preferably by molding. Alternatively, the inside diameter-reducing annular end members 12 can be formed by grinding or cutting the annular ends of a paperboard tubular member to achieve the desired tongues 18 and grooves 22 on one end thereof.

Following formation of the central core body member 10 and the inside diameter-reducing annular end members 12, the two annular end members are joined to the central core body member 10 preferably employing any of various well known adhesive materials including latex or solvent-based and/or thermosetting adhesive materials. The adhesive materials are applied to the annular end surfaces of either, or both of, the central core body or the annular end members 12. Thereafter the end members are joined to the central core body and axial pressure is applied. Because the tongues and grooves of the central core body member, and the tongues and grooves of the inside diameter-reducing end members are inserted axially into each other, the adhesive material applied to the various tongues and grooves is forced into and maintained within the thus formed joint, resulting in even and permanent bonding of the end members to the central core body member.

In general, the use of tongues and grooves for mechanical interlocking of the inside diameter-reducing annular end members to the central core body member provides a number of significant benefits and advantages in the core assemblies of the invention. As indicated above, adhesive material is forced into, and not out of, the joint formed during the adhesive bonding process. In addition, the inside diameter-reducing annular end members are locked positively into the central core body member so that circumferential motion is positively transferred from one body member to the other and so that axially inward pressure on either or both of the inside diameter-reducing end members is positively transferred to the central core body member.

The central core body member 10 typically has an inside diameter of from a few inches, for example, three inches up to 6–7 inches or greater, preferably about 6 inches. The central core body member 10 generally has an extended length ranging from about 1 foot or more up to about 11 feet or greater, however, the benefits and advantages of the invention are most apparent when the entire-tubular core assembly has a length of greater than about five feet, in view of the known problems as to vibration and dynamic strength performance with such elongated tubular core bodies as discussed previously.

The inside diameter-reducing annular end members 12 typically have a longitudinal length based on the desired end use of the tubular core assembly and preferably will have a length which is about the same or greater than the chuck or reel stub shaft intended to be inserted into the tubular core assembly. Typically, the length of the inside diameter-reducing end members 12 will range from about 1 inch to about 18 inches or more.

Figure 3:
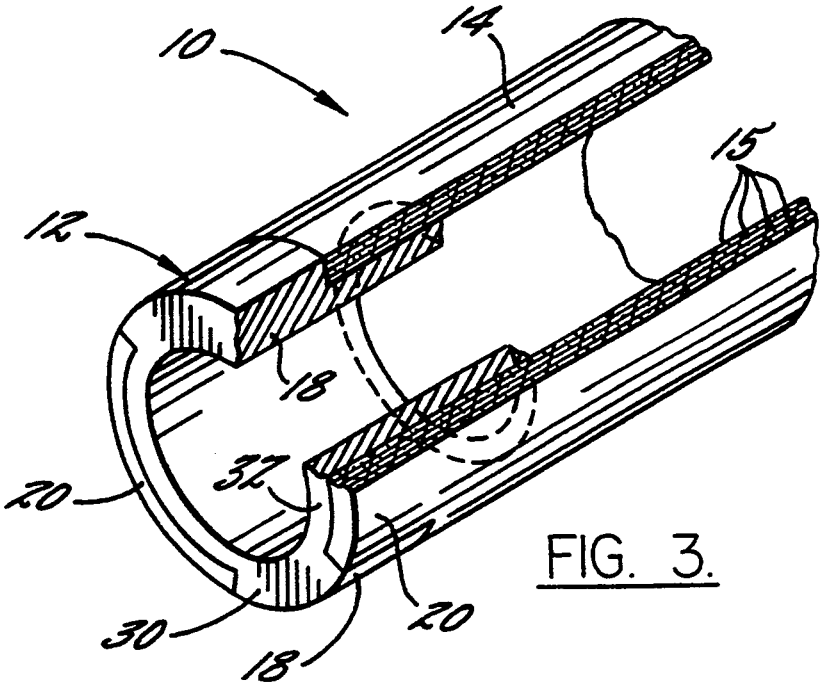
FIG. 3 is a perspective view of one end of another preferred tubular core assembly according to the invention, a portion thereof being broken away to illustrate its construction.

FIG. 3 illustrates another preferred embodiment of the invention in which the inside-diameter reducing annular end member 12 is constructed to have only a portion of its exterior diameter the same as the exterior diameter of the central core body 14. In this embodiment, the two tongues 20 of the main core body 14 extend outwardly to and form a portion of the composite end face 30 of the core body assembly. The annular end member 12 includes two matching grooves which extend radially through only a portion 32 of the bodywall of the end member 12. As seen in the drawing the radial depth of the grooves in the end member is the same as the wall thickness of the bodywall of the central core body. Notched tongues 18 of the end member 12 are received in corresponding axially extending grooves in the central core body 14 which also extend radially fully through the entire bodywall of central core body 14.

Figure 2:
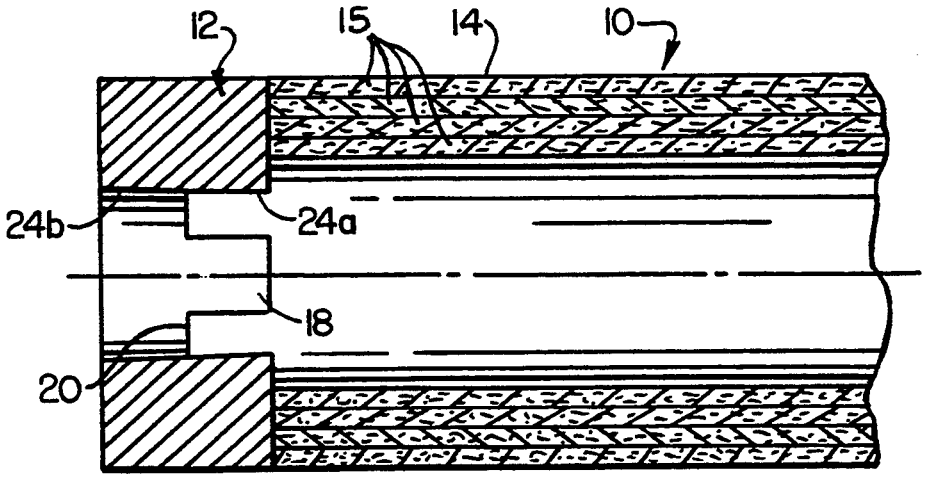
FIG. 2 is a cross-sectional side view of one end portion of a core assembly of the invention showing the inside diameter-reducing annular end member secured to one end of the central core body.

As indicated previously, in a particularly preferred embodiment of the invention, the interior peripheral surface 24 (FIG. 1) of the inside diameter-reducing annular end members 12 can be profiled to match the exterior profile of a reel stub shaft used in winding and unwinding equipment as disclosed in U.S. Pat. No. 4,875,636. Thus, the interior surface of the inside diameter-reducing annular end members can include a first portion positioned at location 24*a* (FIG. 2) tapering radially outwardly in the axially outward direction, preferably at an angle of approximately 2° with respect to the longitudinal central axis of the tubular core assembly, and a second portion at location 24*b* extending axially outwardly from the first portion at location 24*a* and tapering radially outwardly at a second predetermined angle, preferably approximately 33° with the respect to the central axis of the tubular core assembly. In addition, the inside surface 24 can include one or more grooves for receiving a spline or the like on the exterior of a reel stub shaft of conventional winding or unwinding equipment. Such preferred profiled interior surfaces are discussed and illustrated in greater detail in U.S. Pat. No. 4,875,636, which has previously been incorporated herein by reference.

The core assemblies of the invention can also be used with conventional metal inserts for receiving stub shafts or chucks; however, as discussed above, such metal inserts are not necessary in preferred embodiments of the invention. As indicated previously, a conventional core plug can advantageously be incorporated into the annular opening of the inside diameter-reducing annular end members during shipping and storage of the core assembly bodies of the invention in order to protect the ends thereof. Such core plugs are generally known to those skilled in the art and exemplary core plugs are also disclosed in the previously mentioned U.S. Pat. No. 4,875,636.

The invention has been described in considerable detail with reference to its preferred embodiments, however, it will be apparent that numerous variations and modifications can be made without departing from the spirit and scope of the invention as described in the foregoing detailed specification and defined in the appended claims.

That which is claimed is:

1. A tubular core assembly for a roll of paper or other sheet material comprising:

an elongate hollow cylindrical central core body member comprising a bodywall and having opposed ends, a predetermined outside diameter, and a predetermined inside diameter;

inside diameter-reducing annular end members, each having an exterior periphery of which at least a portion defines the same outside diameter as said central core body member and having a predetermined inside diameter less than the inside diameter of said central core body member;

each of said annular end members being secured to an opposed end of said central core body member in coaxial relation therewith;

a plurality of axial grooves integrally formed in said bodywall of said central core body member, said grooves having a depth extending substantially through said bodywall; and a plurality of axially extending tongue members integrally formed in an end of each of said annular end members received in said grooves of said central core body member in interlocking relationship therewith;

whereby said inside diameter-reducing annular end members are secured to said central core body member in positive circumferential locking relationship.

2. The tubular core assembly of claim 1 wherein said grooves in said bodywall of said central core body member extend fully through said bodywall.

3. The tubular core assembly of claim 2 wherein there are an even number of said grooves in said bodywall of said central core body member symmetrically arranged such that said grooves form a plurality of opposed groove pairs wherein the grooves within each pair are positioned 180° with respect to each other.

4. The tubular core assembly of claim 2 wherein said grooves in said bodywall of said central core body member are rectangularly shaped.

5. The tubular core assembly of claim 2 wherein said opposed ends of said central core body member additionally comprise a plurality of tongues defined by, and alternating between, said grooves and wherein said tongues have a circumferential dimension greater than the circumferential dimension of said grooves.

6. The tubular core assembly of claim 2 wherein the bodywall of said central core body member is formed of multiple layers of paperboard.

7. The tubular core assembly of claim 6 wherein said inside diameter-reducing annular end members comprise a cellulosic-based material.

8. The tubular core assembly of claim 7 wherein said inside diameter-reducing annular end members are formed by molding said cellulosic-based material.

9. The tubular core assembly of claim 8 wherein said cellulosic-based material comprises wood particles.

10. The tubular core assembly of claim 1 wherein said inside diameter-reducing annular end members comprise a profiled interior surface adapted to match the exterior profile of a chuck on a winding or unwinding apparatus.

11. The tubular core assembly of claim 10 wherein said profiled interior surface matches the exterior profile of a reel stub shaft of a printing press.

12. The tubular core assembly of claim 10 wherein said profiled interior surface matches the exterior profile of a reel stub shaft of a Rotogravure press.

13. The tubular core assembly of claim 10 wherein said inside diameter-reducing annular end members have an average wall thickness sufficient to reduce the inside diameter of a six inch inside diameter central core body member to an inside diameter of about three inches.

14. The tubular core assembly of claim 1 wherein said tubular core assembly has a longitudinal length ranging from about 5 feet to about 11 feet.

15. The tubular core assembly of claim 14 wherein said inside diameter-reducing annular end members each have a length of between about 1 and about 18 inches.

16. The tubular core assembly of claim 1 wherein said annular end members each comprise a plurality of axially extending grooves for receiving corresponding axially extending tongues on said central core body member, said axially extending grooves on said end member having a radial thickness less than the difference between the outside diameter and the inside diameter of said end member at portions thereof adjacent said grooves.

17. The tubular core assembly of claim 16 wherein the radial thickness of said grooves in said end member is the same as the thickness of the bodywall of said central core body member.

18. The tubular core assembly of claim 1 wherein said end members and said central core body member are each spiral wound paperboard tubular bodies.

* * * * *